US007257951B2

(12) United States Patent
Xing

(10) Patent No.: US 7,257,951 B2
(45) Date of Patent: Aug. 21, 2007

(54) SOLAR WATER COOLER

(75) Inventor: Yicun Xing, Hainan (CN)

(73) Assignee: Wei Bao Shen, Rosemead, CA (US)

( * ) Notice: Subject to any disclaimer, the term of this patent is extended or adjusted under 35 U.S.C. 154(b) by 317 days.

(21) Appl. No.: 11/165,684

(22) Filed: Jun. 24, 2005

(65) Prior Publication Data

US 2005/0284151 A1 Dec. 29, 2005

(51) Int. Cl.
*F25B 21/02* (2006.01)

(52) U.S. Cl. ..... 62/3.2; 62/3.6; 62/389

(58) Field of Classification Search ..... 62/3.2, 62/3.6, 156, 259.1, 389, 395
See application file for complete search history.

(56) References Cited

U.S. PATENT DOCUMENTS 4,058,718 A * 11/1977 Palka ..... 362/238
6,029,461 A * 2/2000 Zakryk ..... 62/93
6,058,718 A * 5/2000 Forsberg et al. ..... 62/125
6,684,648 B2 * 2/2004 Faqih ..... 62/93

* cited by examiner

*Primary Examiner*—Melvin Jones
(74) *Attorney, Agent, or Firm*—Raymond Y. Chan; David & Raymond

(57) ABSTRACT

The present invention discloses a solar water cooler, which includes a water tank, a condensing panel, and an auxiliary refrigerating devices, wherein the water tank has an insulating panel transversely embedded into the water tank for separating the water tank into an upper cooling chamber and a lower chilling chamber, a pair of inner conduits for respectively communicating the cooling chamber to the chilling chamber, each of the cooling chamber and the chilling chamber has a water inlet port and a water outlet port, a plurality of conduits for respectively communicating the water tank to the condensing panel and the auxiliary refrigerating devices, wherein the auxiliary refrigerating device electrically powered by solar cells and by thermocells.

4 Claims, 1 Drawing Sheet

SOLAR WATER COOLER

BACKGROUND OF THE PRESENT INVENTION

1. Field of Invention

The present invention relates to refrigeration system, and more particularly, relates to a refrigerating system directly or indirectly utilizing solar energy to achieve an efficient performance.

2. Description of Related Arts

Energy is an unavoidable topic in the new century. It is witnessed that sciences and technologies related to the energy industry had been significantly concerned all over the world. Especially, the solar energy, widely considered as an unexhausted energy source, had been employed in a variety of applications, such as refrigeration industry. Nowadays, the solar energy refrigeration is exclusively focused on the air-conditioning refrigeration, in which a plurality of refrigerating modes had been unveiled, such as, solar absorption refrigeration, solar adsorption refrigeration, solar mechanic compression refrigeration, solar dehumidification refrigeration, solar injection refrigeration, and so on. However, the above mentioned solar air-conditioning devices are so complicated and costly, which in turn, restricting its prevailed applications in practices. As a result, it is rarely seen such solar refrigerating means had been used for household purposes. What is more, such solar refrigerating means are supposedly operated under sealed or closed chambers, the ventilation is out of reach thus resulting the air quality really unserviceable. To a worse extent, CFC had been sometimes employed in some occasions. The damage to the environment of the CFC was terrible. The solar cold water air-conditioner had been introduced in 1980s, wherein the solar energy is converted into heat for producing cold water. A very common method for producing cold water is the heat absorption process, wherein the water is utilized as refrigerating medium, and the lithium bromide is employed as absorbing agent. Unfortunately, the dehumidification process would be a bottleneck and low temperature chilled water ranging from 7–9° C. had to be prepared for ensuring such dehumidification. It is noted that whenever a single centigrade dropped of such chilled water temperature, the refrigerating efficiency of such refrigerating process would be decreased by 3%. This is undesirable for most users. In short, such solar absorption refrigeration is still costly, complicated, and bulky in occupied area.

SUMMARY OF THE PRESENT INVENTION

A primary object of the present invention is to provide a solar dual-temperature water cooler, which is capable of lowering the water temperature to the lowest temperature of surrounding environment by radiating means so as to obtain low-temperature cooling water, which in turn could be directed into the refrigerating device for enhancing the overall efficiency of the refrigerating device. Furthermore, such cooling water could be prepared to generate chilled water which is capable of absorbing heat along the conduit in the refrigerating process.

Accordingly, to achieve above object, the present invention provides a solar dual-temperature water cooler, comprising:

a water tank for reserving a predetermined volume of water, wherein the water tank is made of building material, or prepared in such a manner that the water tank comprises an inner flask made of stainless steel, an insulating layer made of foam plastic, and an outer casing made of aluminum plate;

an insulating panel transversely embedded into the water tank for separating the water tank into an upper cooling chamber and a lower chilling chamber;

a pair of inner conduit for respectively communicating a lower portion and a upper portion of cooling chamber to a counterpart lower portion and a counterpart upper portion of the chilling chamber, wherein each of cooling chamber and the chilling chamber has a water inlet port defined on a upper wall and a water outlet port defined on a lower wall, and a reflux pump is coupled to the chilling chamber water inlet port for ensuring a chilled water be circularly serviced;

a condensing panel disposed above the cooling chamber and is mounted against an outer wall of a building to be integrally formed with the building, wherein the condensing panel comprises a radiating manifold and a plurality of radiating fins provided thereon for radiating a heat of the condensing panel, a pair of condensing conduit for correspondingly communicating a upper portion and a lower portion of the condensing panel to respective upper portion and lower portion of the cooling chamber;

an auxiliary refrigerating device disposed above the chilling chamber, wherein the auxiliary refrigerating device comprises a thermopile refrigerating unit and a temperature monitor unit, the thermopile refrigerating unit has a chilled water conduit respectively for communicating the upper portion and lower portion of the chilling chamber, so that water of the upper portion of the cooling chamber, having a higher temperature, will be flowed to the condensing panel to be naturally radiated, and then flowed back to the lower portion of the cooling chamber with a circular manner so as to ensure the water reserved within the cooling chamber reach a lowest temperature of the environment generating the cooling water, wherein the cooling water is capable of being directed to the refrigerating device to refrigerate the condenser of the refrigerating device for enhancing the refrigerating efficiency, and being refluxed to the upper portion of the cooling chamber;

since the inner conduits are provided for correspondingly communicating the mating portions of the cooling chamber and the chilling chamber, the water reserved within the chilling chamber will be cooled down to the environmental temperature; furthermore, in case the chilled water temperature is now low enough, the temperature monitor unit would initiate the thermopile unit to lower the temperature of the water reserved within the chilling chamber, wherein the chilled water could be directed into the chilling conduit to absorb the heat under a refrigerating circumstance, afterwards, the heat absorbed chilled water would be refluxed into the upper portion of the chilling chamber, if the chilled water temperature is higher than the temperature of the cooling water, the water of the upper portion of the chilling chamber would be flowed into the upper portion of the cooling chamber via the inner conduit, at the same time, the water of the lower portion of the cooling chamber would be flowed into the lower portion of the chilling chamber.

Finally, it is noted that the auxiliary refrigerating device of the present invention is electrically powered by solar cells or by thermocell. The solar energy dual-temperature water coolers according to the present invention is of solid cost saving, simple and convenient operation, and free of pollution, and more importantly, available to most household applications.

These and other objectives, features, and advantages of the present invention will become apparent from the following detailed description, the accompanying drawings, and the appended claims.

DETAILED DESCRIPTION OF THE PREFERRED EMBODIMENT

Figure 1:
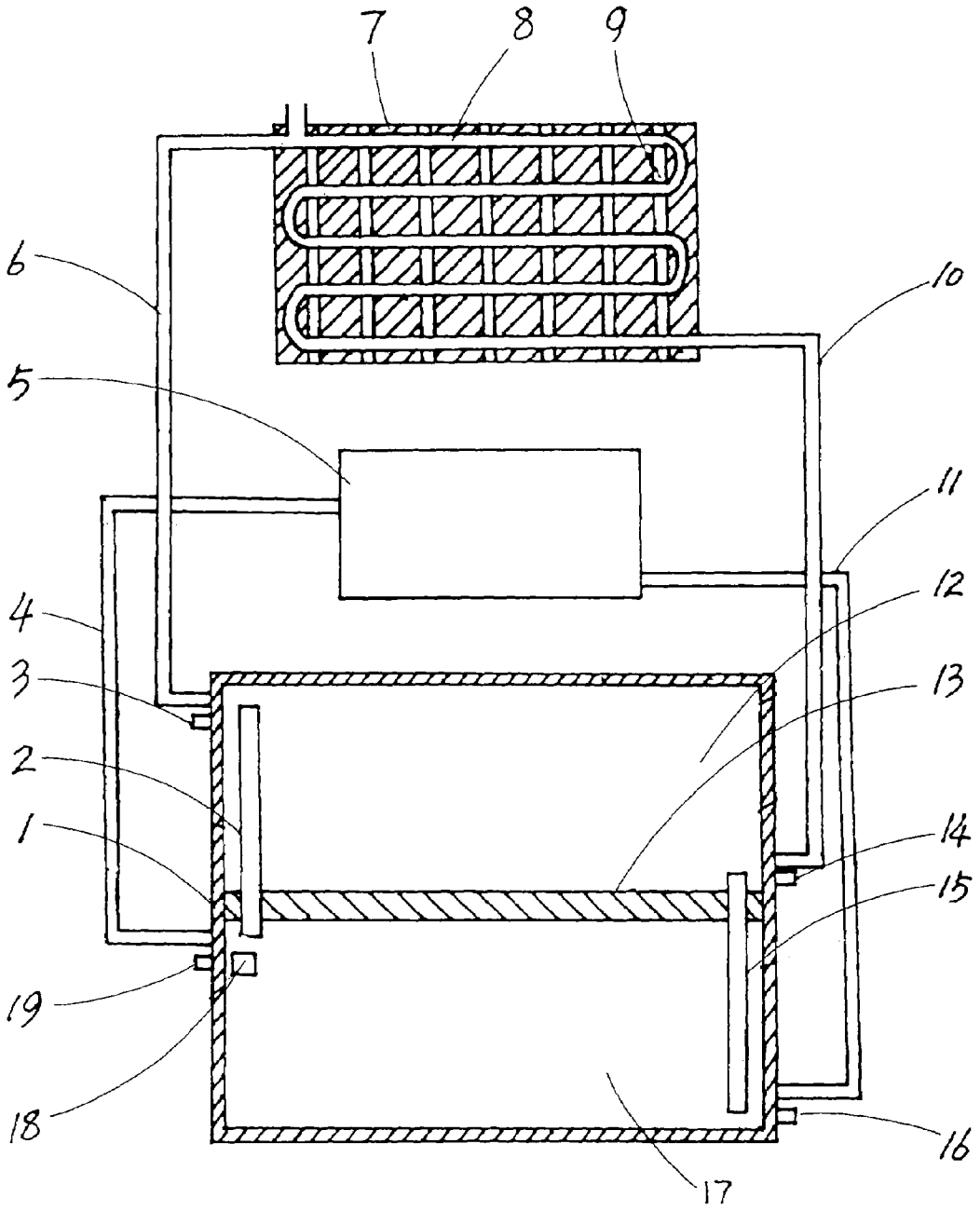
FIG. 1 is a schematic view of the solar energy dual-temperature water cooler according to the preferred embodiment of the present invention.

Referring to FIG. 1, the solar water cooler according to the preferred embodiment of the present invention is illustrated. The water tank 1 has an insulating panel 13 transversely imbedded thereon for separating the water tank 1 into an upper cooling chamber 12 and a lower chilling chamber 17, wherein two inner conduits 2, 15 are disposed penetrating the insulating panel 13 for respectively communicating upper portions of the cooling chamber 12 to the upper portion of the chilling chamber 17 freezing tank, and for communicating lower portion of the cooling chamber 12 to the corresponding lower portion of the chilling chamber 17. Furthermore, a pair of water inlet ports 3, 19 is respectively provided at the upper side wall of the cooling chamber 12 and the chilling chamber 17. On the other hand, a pair of water outlet ports 14, 16 is provided at the lower side wall of the cooling chamber 12 and the chilling chamber 17 respectively. A reflux pump 18 is disposed within the chilling chamber 17 to couple with the water inlet port 19 for recycling the chilled water; a condensing panel 7 is provided at a position above the cooling chamber 12, wherein the condensing panel 7 is mounted biasing against an outer wall of a building and integrally formed with the building. Furthermore, the condensing panel 7 further comprises a radiator manifold 8 and a plurality of radiator fins 9 mounted on the condensing panel 7 thereon, so as to ensure the condensing panel 7 having a great radiating effect. It is noted that there is an exposing opening defined at the water inlet of the radiator manifold 8 for communicating the radiator manifold 8 to outside. There is a first condensing conduit 6 provided for communicating the condensing panel 7 with the upper portion of the cooling chamber 12, correspondingly, there is a second condensing conduit 10 for communicating the water outlet of the condensing panel 7 to the lower portion of the cooling chamber 12; There is an auxiliary refrigerating device 5 provided at a position above the chilling chamber 17, wherein the auxiliary refrigerating device 5 comprises a first chilled water conduit 4 for communicating the upper portion of the auxiliary refrigerating device 5 to the upper portion of the chilling chamber 17, and a second chilled water conduit 11 for correspondingly communicating the lower portion of the auxiliary refrigerating device 5 to the lower portion of the chilling chamber 17. since the weight ratio of the hot water is relatively lighter than that of the cold water, so that the water in the upper portion of the cooling chamber 12, having a relatively higher temperature, would be flowed into the condensing panel 7 to be naturally radiated, afterwards, the cooled water would be refluxed to the lower portion of the cooling chamber 12 in a circular manner, as a result, the water reserved within the cooling chamber 12 would be gradually cooled down until the water temperature reach the environmental temperature. Subsequently, the water reserved in the cooling chamber 12 could be leaded out via the water outlet 14 to be applied onto the refrigerated devices so as to cool down the condensing means of the refrigerated appliances for enhancing the cooling efficiency. Moreover, the water applied to the refrigerated appliances would be refluxed to the upper portion of the cooling chamber 12; since the upper portion and lower portion of the cooling chamber 12 are correspondingly communicated to the respective counterpart portions of the chilling chamber tank 17 via the inner conduits 2, 15, and the water temperature reserved within the chilling chamber 15 would be lowered to reach the ambient temperature. In case the water temperature of the chilling chamber 13 was not qualified to meet a lower work temperature, the temperature monitor unit of the auxiliary refrigerating device 5 would initiate the thermopile unit to further lower the temperature of the water reserved in the chilling chamber 17 to obtain the desirable chilled water. The chilled water is directed out via the water outlet 16 to the refrigerating environment to absorb heat, afterwards, the heat-absorbed chilled water would be refluxed into the upper portion of the chilling chamber 17 via the water outlet 19 or pumped back into the upper portion of the chilling chamber 17. If the temperature of such chilled water is higher than the cooling water temperature, the water of the upper portion of the chilling chamber 17 would be flow into the cooling chamber 12 via the inner conduit 2, and at the same time, water of the lower portion of the cooling chamber 12 would be flowing into the lower portion of the chilling chamber 17 via the other inner conduit 15. Finally, it is worth to mention that the water tank of the present invention is made of building materials, or prepared with such a structure wherein the inner flask is made of stainless steel, the insulating layer is made of foamed plastic and the outer casing is made of aluminum plate. According to the present invention, the auxiliary refrigerated device is powered by solar cells or thermoelectric cells.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A solar water cooler, comprising:

a water tank for reserving a predetermined volume of water;

an insulating panel transversely embedded into said water tank for separating said water tank into an upper cooling chamber and a lower chilling chamber;

a pair of inner conduits for respectively communicating a lower portion and a upper portion of said cooling chamber to a counterpart lower portion and a counterpart upper portion of said chilling chamber, wherein each of said cooling chamber and said chilling chamber has a water inlet port defined on an upper side wall and a water outlet port defined on a lower said wall;

a condensing panel disposed above said cooling chamber and is mounted against an outer wall of a building to be integrally formed with said building, wherein said condensing panel comprises a radiating manifold and a plurality of radiating fins provided thereon, and an exposing opening defined on said radiating manifold for communicating said radiating manifold to outside;

a pair of condensing conduit for correspondingly communicating a upper portion and a lower portion of said condensing panel to respective upper portion and lower portion of said cooling chamber; and an auxiliary refrigerating device disposed above said chilling chamber, wherein said auxiliary refrigerating device comprises a thermopile refrigerating unit and a temperature monitor unit, said thermopile refrigerating unit has a chilled water conduit respectively for communicating said upper portion and said lower portion of said chilling chamber.

2. The solar water cooler, as recited in claim 1, wherein said water tank is made of building material, or prepared in such a manner that the water tank comprises an inner flask made of stainless steel, an insulating layer made of foam plastic, and an outer casing made of aluminum plate.

3. The solar water cooler, as recited in claim 1, wherein a reflux pump coupled to said chilling chamber water inlet port for ensuring a chilled water be circularly serviced.

4. The solar water cooler, as recited in claim 1, wherein said auxiliary refrigerating unit is electrically powered by solar cells or by thermocells.

* * * * *